US006293270B1

(12) United States Patent
Okazaki

(10) Patent No.: US 6,293,270 B1
(45) Date of Patent: Sep. 25, 2001

(54) MANUFACTURING METHOD OF LIQUID JET RECORDING HEAD, LIQUID JET RECORDING HEAD MANUFACTURED BY THIS MANUFACTURING METHOD, AND MANUFACTURING METHOD OF ELEMENT SUBSTRATE FOR LIQUID JET RECORDING HEAD

(75) Inventor: Takeshi Okazaki, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/333,042

(22) Filed: Jun. 15, 1999

(30) Foreign Application Priority Data

Jun. 17, 1998 (JP) ..... 10-186844

(51) Int. Cl.[7] ..... B28D 1/04

(52) U.S. Cl. ..... 125/13.01; 125/23.01; 83/508.1

(58) Field of Search ..... 125/13.01, 23.01; 83/495, 508.1, 864, 883

(56) References Cited

U.S. PATENT DOCUMENTS 4,167,174 * 9/1979 Hampton et al. ..... 125/13.01
4,407,262 * 10/1983 Wirz et al. ..... 125/13.01
4,851,371 7/1989 Fisher et al. .
5,730,113 * 3/1998 Wildes et al. ..... 125/13.01
5,803,797 * 9/1998 Piper ..... 125/23.01 X

FOREIGN PATENT DOCUMENTS 2806576 7/1998 (JP) .

* cited by examiner

*Primary Examiner*—Joseph J. Hail, III
*Assistant Examiner*—Anthony Ojini
(74) *Attorney, Agent, or Firm*—Fitzpatrick, Cella, Harper & Scinto

(57) ABSTRACT

In a manufacturing method of a liquid jet recording head, an element substrate for the liquid jet recording head having an energy generating element for generating energy utilized to discharge a liquid from a discharge port, and a roof plate having a concave portion as a passage of the liquid communicated with the discharge port are joined to each other such that the energy generating element and the concave portion correspond to each other. The passage is formed by this joining. The element substrate is manufactured by including a process for cutting a substrate for cutting-out a plurality of the element substrates from its one face side by a cutting blade and forming a cutting groove in the substrate and a process for traveling a cutting blade so as to trace the cutting groove from the other face side of the substrate.

11 Claims, 5 Drawing Sheets

MANUFACTURING METHOD OF LIQUID JET RECORDING HEAD, LIQUID JET RECORDING HEAD MANUFACTURED BY THIS MANUFACTURING METHOD, AND MANUFACTURING METHOD OF ELEMENT SUBSTRATE FOR LIQUID JET RECORDING HEAD

BACKGROUND OF THE INVENTION

1. Field of the Invention

The present invention relates to a manufacturing method of a liquid jet recording head used in a liquid jet recording system for performing a recording operation to a recording medium such as recording paper, etc. by discharging a recording liquid such as ink, etc. as a liquid droplet from a very small discharge port, a liquid jet recording head manufactured by this manufacturing method, and a manufacturing method of an element substrate for the liquid jet recording head. The liquid jet recording head manufactured by the present invention can be applied to a printer, a copying machine, a facsimile telegraph having a communication system, a device such as a word processor, etc. having a printer section, and a recorder for industry compositely combined with various kinds of processors, which perform a recording operation to a recorded medium such as paper, thread, fibers, cloth textile, leather, metal, plastic, glass, wood, ceramics, etc. Here, "record" in the present invention means giving an image having no meaning such as a pattern, etc. to the recorded medium as well as giving an image having a meaning such as characters, figures, etc. to the recorded medium.

2. Related Background Art

A liquid jet recording head used in a liquid jet recording system (an ink jet recording system) has a unit element and a roof plate in one typical form. In the unit element, plural discharging energy generating elements are formed on a substrate at a predetermined interval. The roof plate has plural discharge ports for discharging a recording liquid such as ink, etc. and also has plural grooves as flow paths respectively communicated with the discharge ports. The liquid jet recording head is obtained by joining the unit element and the roof plate to each other in a state in which positions of the discharging energy generating elements and the grooves as flow paths are accurately aligned with each other. This liquid jet recording head is constructed such that characters are printed to the recording medium such as recording paper, etc. by jetting the recording liquid as a droplet from the discharge ports by giving discharging energy to the recording liquid within the flow paths by the discharging energy generating elements.

In the liquid jet recording head, consistency of an increase in printing speed and an improvement of an image quality has recently been required. For example, there is an elongated liquid jet recording head as shown in FIG. 4 as a liquid jet recording head able to cope with this consistency. In the elongated liquid jet recording head of this kind, plural unit elements 100 (a first substrate) having plural discharging energy generating elements (e.g., heating elements) 101 are precisely positioned and arranged on a base plate 102 made by a material such as a metal, ceramics, etc. so that a recording element of an elongated line head is made. Plural discharge ports 106 for discharging the recording liquid and a roof plate 105 (a second substrate) are joined to each other on this recording element so that the liquid jet recording head is manufactured. The roof plate 105 has a concave portion for constituting unillustrated plural liquid flow paths communicated with the respective discharge ports 106 and an unillustrated common liquid chamber for supplying the recording liquid to each of the liquid flow paths (the liquid flow paths and the common liquid chamber are generally called "a passage"). The unit elements 100 each having plural heating elements as the discharging energy generating elements 101 are manufactured by cutting a silicon substrate formed by patterning the plural unit elements in a film forming process, etc. and separating the individual unit elements from each other. Such an elongated liquid jet recording head is a high function recording head able to realize a high definition image by increasing an arranging density of the discharging energy generating elements (heating elements) and a processing density of the grooves of the roof plate.

In a manufacturing process of this elongated liquid jet recording head, an important technique for preventing a reduction in image quality caused by a connecting stripe at a high recording density is to arrange the unit elements precisely and closely as much as possible. Cutting of the silicon substrate with high accuracy is required to obtain such high arranging accuracy.

Japanese Patent Application Laid-Open No. 2-212162 (U.S. Pat. No. 4,851,371) discloses an effective technique with respect to such a requirement of the cutting accuracy and an improvement of the arranging accuracy relative to this requirement. Namely, a problem exists in that a circuit network is cut into pieces by microscopic damage (fine damage such as chipping, cracking, etc.) caused on a chip surface at a cutting time of a silicon wafer. To solve this problem, the silicon wafer is cut by precisely inclining a cutting blade along a cutting street between the unit elements to be partially cut. Thus, this technique realizes an arranging structure in which the unit elements come in line contact with each other on the surface of a cutting portion, but are separated from each other on a bottom face of the cutting portion.

However, in the technique disclosed in the above Japanese Patent Application Laid-Open No. 2-212162, it is necessary to perform cutting for forming a face having a cut end inclined twice and processing (cutting or etching) for removing an unnecessary portion. Therefore, it is required that an arranging width (the distances in longitudinal and transversal directions between the unit elements) of the unit elements integrated within the silicon wafer is secured to a certain extent. Further, it is very difficult to prevent the damage of the chip surface from reaching a circuit pattern when no thin blade is used as the used cutting blade even when these distances can be secured by setting the arranging width to be narrow. In the cutting using the thin cutting blade, dispersion tolerance of a cutting width is large as described in the above publication. To remove this dispersion tolerance, it is necessary to smooth (precut, dressing, etc.) a resin adhesive blade considerable times. Therefore, when a large number of unit elements are produced by cutting, it is anticipated that a time required to process one product is considerably increased. It is necessary to rotate the heating element wafer 180 degrees to make a pair of inclined cut ends oppositely directed to each other. However, considerable high accuracy is also required with respect to this rotation.

SUMMARY OF THE INVENTION

To solve the above problems in the requirement of severe accuracy and control of the normal cutting blade, the inventors of this application noticed "surface roughness of the blade" in addition to a main parameter for determining "curving of the blade" disclosed in the above publication, etc. and sincerely considered this surface roughness. In the present situation, it is impossible to perfectly remove chipping and cracking on the surface of a sectional cut end even when a blade thickness, an exposure amount, a depth of the cut end, a dicing speed, etc. with respect to the cutting blade are adjusted as much as possible. However, it has been found as a result that a state of the cutting blade at its cutting time becomes preferable and linearity of the cutting blade becomes excellent as roughness of particles forming the blade surface is finely constructed. However, when the surface roughness of the blade is set to be excessively fine, problems of fragility and rapid wearing of the blade, etc. are caused. Therefore, it is necessary to specify a suitable surface roughness range. A condition for obtaining a preferable cutting state is qualitatively to slowly cut the silicon wafer by a blade having a suitable thickness and a fine surface roughness. In view of such knowledge, the inventors of this application have completed the present invention as a technique for solving the above-mentioned problems.

In consideration of the above unsolved problems of the prior art, one object of the present invention is to provide a manufacturing method of a liquid jet recording head, the liquid jet recording head manufactured by this manufacturing method, and a manufacturing method of an element substrate for the liquid jet recording head in which the damage of a chip surface in a cutting portion can be prevented without requiring any excessive high cutting accuracy when individual unit elements are manufactured by cutting a silicon wafer, and cut end faces of the unit elements for improving an arranging accuracy of the unit elements can be obtained.

Another object of the present invention is to provide a manufacturing method of a liquid jet recording head in which an element substrate for the liquid jet recording head having an energy generating element for generating energy utilized to discharge a liquid from a discharge port, and a roof plate having a concave portion as a passage of the liquid communicated with the discharge port are joined to each other such that the energy generating element and the concave portion correspond to each other, and the passage is formed by this joining; and the element substrate is manufactured by including the following processes:

a process for cutting a substrate for cutting-out a plurality of the element substrates from its one face side by a cutting blade and forming a cutting groove in the substrate; and a process for traveling a cutting blade so as to trace the cutting groove from the other face side of the substrate. Further, one object of the present invention also is to provide a liquid jet recording head manufactured by such a manufacturing method of the liquid jet recording head in which a plurality of the element substrates are arranged in parallel with each other such that end faces of the element substrates formed with high accuracy are joined to each other.

A still another object of the present invention is to provide a manufacturing method of a liquid jet recording head obtained by joining an elongated substrate series having plural first substrates having plural heating elements arranged in parallel with each other, and a second substrate which has plural discharge ports for discharging a liquid by utilizing heat generated from the heating elements and also has a concave portion as a passage communicated with the plural discharge ports;

the first substrates being manufactured by including the following processes:

a first process for mounting a first dicing tape to the rear face of a silicon substrate;

a second process for cutting the silicon substrate from its front face side by a cutting blade and cutting and dividing the first substrates;

a third process for mounting a second dicing tape to front faces of the first substrates; and a fourth process for traveling a cutting blade so as to trace a cutting groove grooved by the cutting through the first dicing tape from a rear face side of the first substrates.

A still another object of the present invention is to provide a manufacturing method of an element substrate for a liquid jet recording head having an energy generating element for generating energy utilized to discharge a liquid, and including the following processes:

a process for cutting a substrate for cutting-out a plurality of the element substrates from its one face side by a cutting blade and forming a cutting groove in the substrate; and a process for traveling a cutting blade so as to trace the cutting groove from the other face side of the substrate.

In accordance with the manufacturing method of the liquid jet recording head of the present invention, a wafer mounting a dicing tape thereto is cut by the cutting blade. Thereafter, a dicing tape is further mounted to the surfaces of unit elements and the wafer is reversely rotated and is again fixed to a dicer. The cutting blade is then traveled so as to trace a cutting street on the front face of the wafer roughly in accuracy by a suitable penetrating amount through the dicing tape from the rear face side. Thus, no unit elements are almost chipped and cracked, and no very high accuracy in position is required. Further, it is possible to obtain a cutting end face required to realize shifting of the unit elements with high accuracy (arranging accuracy) at an arranging time.

Thus, at least a cutting accuracy required in a lowest limit is obtained by only simply adding a rough process (a process for further mounting the dicing tape and tracing and cutting) without arranging a complicated process requiring high accuracy. Therefore, yield can be improved without increasing a time required to process one product so much even at a time of mass production.

DESCRIPTION OF THE PREFERRED EMBODIMENTS

Embodiments of the present invention will next be explained on the basis of the drawings. FIGS. 1A to 1J are perspective views or side views for explaining a manufacturing method of a liquid jet recording head in accordance with a first embodiment of the present invention in a process order. FIG. 2 is a flow chart showing a main process of the manufacturing method of the liquid jet recording head in accordance with the first embodiment of the present invention as a block. The manufacturing method of the liquid jet recording head in accordance with the first embodiment of the present invention will next be explained by using FIGS. 1A to 1J and 2.

Figure 1A:
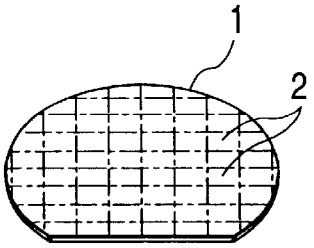
FIGS. 1A, 1B, 1C, 1D, 1E, 1F, 1G, 1H, 1I and 1J are perspective views or side views for explaining a manufacturing method of a liquid jet recording head in accordance with a first embodiment of the present invention in a process order.
Figure 1B:
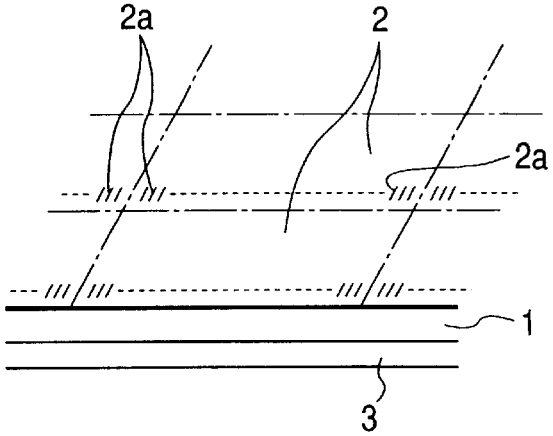
Figure 1C:
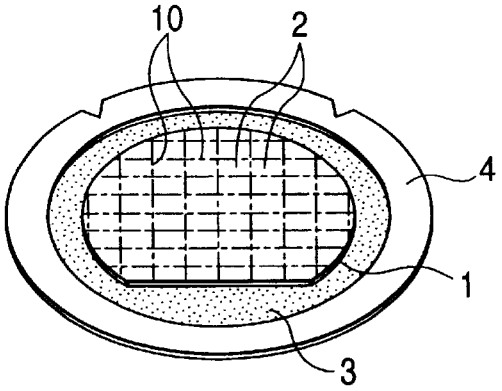
Figure 1D:
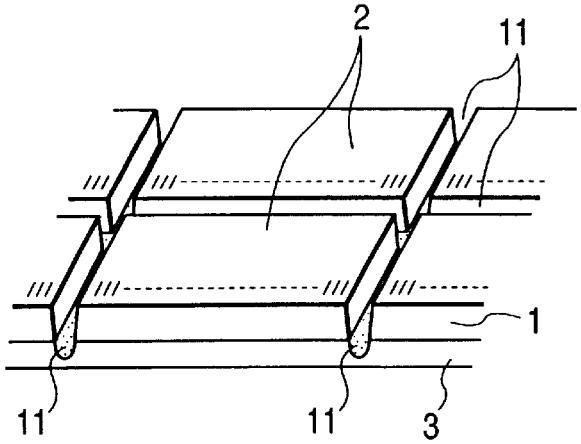
Figure 2:
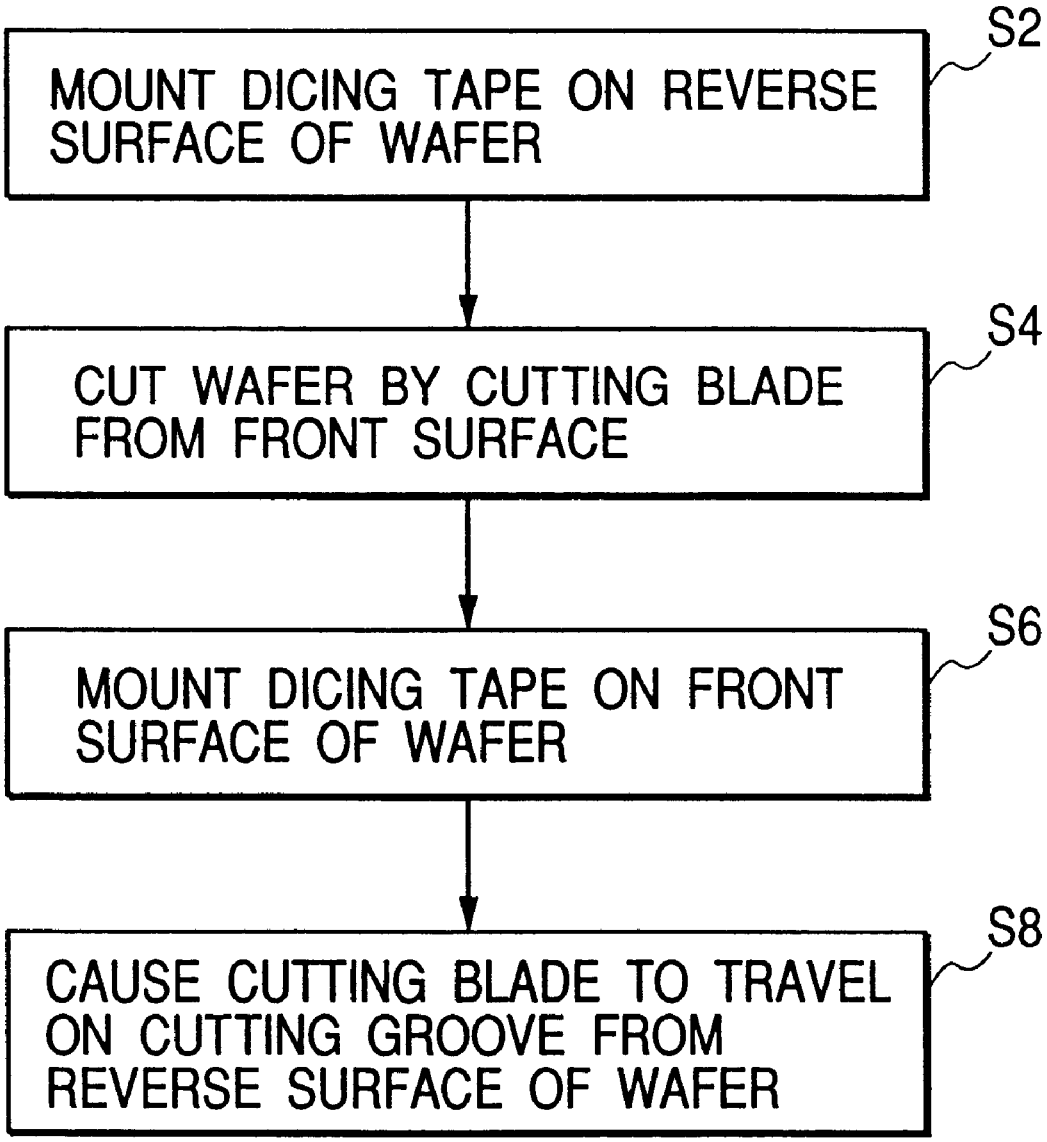
FIG. 2 is a flow chart showing a main process of the manufacturing method of the liquid jet recording head in accordance with the first embodiment of the present invention as a block.

As shown in FIGS. 1A and 1B, a predetermined number of unit elements 2 (a first substrate) having plural heating elements 2*a*, 2*a*, . . . , electrodes, etc. are arranged on the basis of a desirable layout in a silicon wafer 1 (a silicon substrate). First, a dicing tape 3 is mounted to a rear face of this silicon wafer 1 and is attached to a wafer ring 4 (FIGS. 1B and 1C and S2 in FIG. 2). This wafer ring 4 is fixed to an unillustrated dicer as in a normal case, and the silicon wafer 1 is cut by a cutting blade along plural cutting streets 10 and is divided into individual unit elements (chips) 2 (FIG. 1D and S4 in FIG. 2). In this cutting, as shown in FIG. 1D, it is preferable to form a cutting groove 11 by penetrating the cutting blade and cutting the silicon wafer 1 so as to slightly cut-in the dicing tape 3 mounted to the rear face of the silicon wafer 1 simultaneously when the silicon wafer 1 is cut. Concretely, the used cutting blade has 4000 (mesh size) in surface roughness and 0.1 mm ±0.002 mm in width. With respect to a penetrating amount of the blade, the silicon wafer 1 is cut at a height (a distance from a flange end face to a tape bottom face) at which the dicing tape 3 (having 0.08 mm in thickness) stuck to the chips (0.625 mm in thickness) is cut-in by 0.030 mm at the cutting time. A cutting speed is set to 3 mm/sec.

Figure 1E:
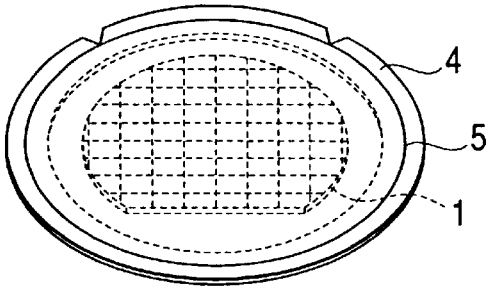
Figure 1F:
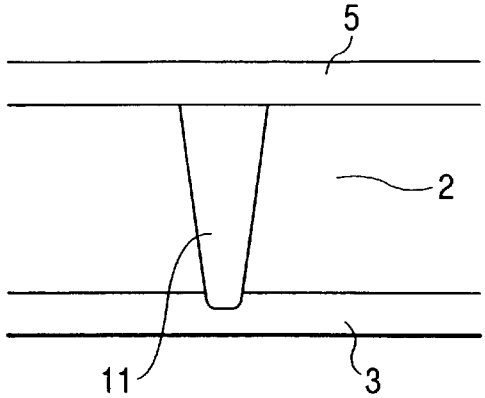
Figure 1G:
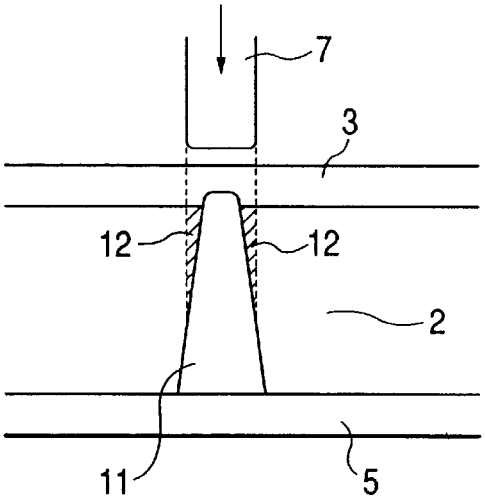
Figure 1H:
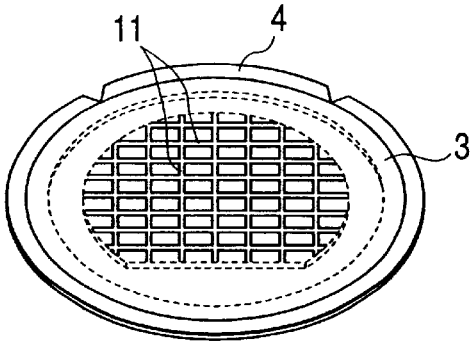

Thereafter, as shown in FIGS. 1E and 1F, a dicing tape 5 is further mounted to surfaces of the unit elements (chips) 2 (S6 in FIG. 2). The silicon wafer 1 is reversely rotated and the wafer ring 4 is fixed to the unillustrated dicer as in the normal case. As shown in FIG. 1G, the same cutting blade 7 as the above cutting blade is traveled so as to trace the cutting groove 11 cut and grooved in the previous cutting process from a rear face side directed upward. While the first mounted dicing tape 3 is cut by this cutting blade 7, the cutting remaining portion of the cutting groove 11 near bottom faces of the chips 2 in the first cutting and irregularities 12 (a hatching portion in FIG. 1G) are cut and removed (S8 in FIG. 2). FIG. 1H shows a state after the silicon wafer is cut so as to trace all cutting grooves 11. In this cutting, it is preferable to cut the dicing tape 3 and further cut the silicon wafer by penetrating the cutting blade 7 so as to cut-in the silicon wafer until about ⅓ to ½ times the thickness of the silicon wafer. Concretely, it is anticipated that the penetrating amount of the blade at the cutting time from this rear face is a cutting amount of the dicing tape+$\alpha$. The silicon wafer is cut-in by 0.2 mm in height from an end face of the dicing tape. A cutting speed is set to 3 mm/sec as in the above case.

Thus, the cutting blade 7 is traveled so as to trace the cutting groove 11 roughly in accuracy by a suitable penetrating amount through the dicing tape 3 from the rear face of the silicon wafer 1 so that the cutting remaining portion of the cutting groove 11 in the first cutting and the irregularities 12 can be cut and removed. Accordingly, it is possible to obtain a cutting end face required to realize shifting of the unit elements with high accuracy (arranging accuracy) at an arranging time.

Figure 1I:
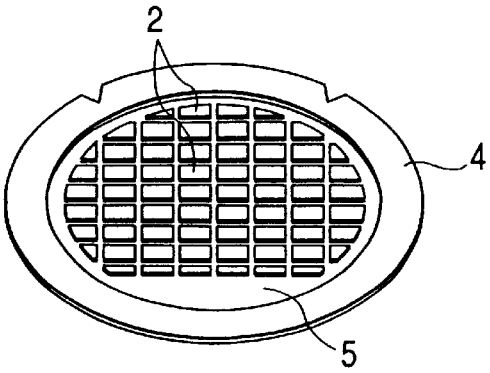
Figure 1J:
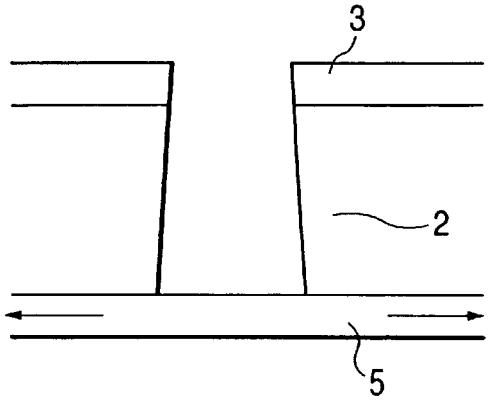

After the silicon wafer is cut so as to trace all the cutting grooves 11, the dicing tape 5 mounted to the chip surfaces is expanded (extended) and the wafer 1 is extended as shown in FIGS. 1I and 1J. Each of the unit elements (chips) is detached from the dicing tape so that the unit elements of preferable cutting accuracy can be obtained.

Figure 4:
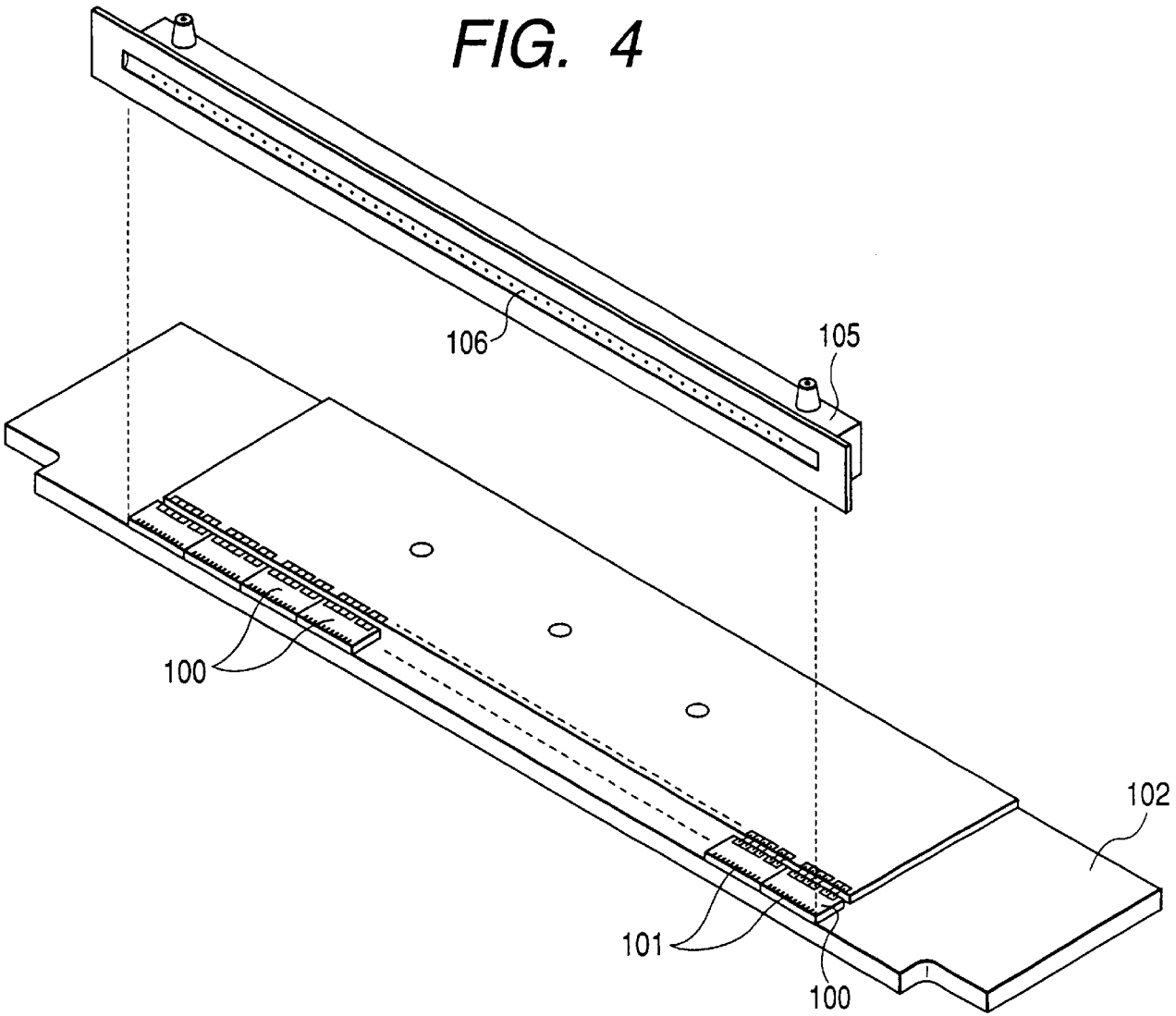
FIG. 4 is an exploded perspective view showing a main portion of an elongated liquid jet recording head.

The preferable cutting accuracy shows a state in which a right angle degree of the wafer at the cutting time is preferable and there are no chipping and no cracking on the chip surfaces, and there are no burrs caused by the cut remainder on the chip bottom faces. Similar to the liquid jet recording head shown in FIG. 4, the unit elements (first substrate) 2 manufactured in this way are arranged on a base plate with preferable arranging accuracy and constitute an elongated substrate series. An elongated roof plate (a second substrate) having a groove shape and a concave portion constituting a discharge port, a liquid flow path, etc. is joined onto this elongated substrate series so that an elongated liquid jet recording head able to obtain a high definition image can be formed.

The cutting blade used in this embodiment has 4000 (mesh size) in surface roughness and 0.1 mm±0.002 mm in width. In this case, a dispersing range of a cutting width is about 0.004 mm and there is almost no cutting street twist (a tracing path of a scribe (line width) caused by the cutting) since the cutting blade has a certain thickness. The surface roughness of the blade at the cutting time from the rear face of the wafer is desirably set to be equal to the surface roughness of the blade in main cutting from a front face of the wafer. The penetrating amount of the blade at the cutting time from the rear face is desirably set to be equal to or smaller than the penetrating amount of the blade in the main cutting from the front face, and is concretely desirably set to lie within a range from 0.1 to 0.3 mm. The cutting speed of the blade at the cutting time from the rear face is desirably set to be equal to or greater than the cutting speed of the blade in the main cutting from the front face, and is concretely set to be equal to or smaller than 3 mm/sec and is particularly desirably set to lie within a range from 1.5 to 3 mm/sec.

As mentioned above, in this embodiment, after the silicon wafer mounted by the tape is cut, the dicing tape is further mounted to surfaces of the unit elements (chips). The silicon wafer is reversely rotated and is again fixed to a dicer. The cutting blade is traveled so as to trace a cutting street on the wafer surface from the rear face side roughly in accuracy by a suitable penetrating amount. Thus, a cutting end face required to realize shifting of the unit elements with high accuracy (arranging accuracy) at the arranging time can be obtained without giving any inclination on side faces of the unit elements. In the above-mentioned prior art, second cutting is performed from the chip surfaces after the wafer is rotated 180 degrees. Therefore, it is necessary to rotate the wafer with considerable accuracy so as not to damage a circuit pattern. However, in this embodiment, since the cutting blade is "traced" through the mount tape from the rear face, no wafer is chipped and cracked and no high accuracy in position is required so that a cutting end face state at a level required in the arranging accuracy in a subsequent process can be obtained.

A cutting process of the silicon wafer based on the manufacturing method of a liquid jet recording head in a second embodiment of the present invention will next be explained with reference to FIGS. 3A to 3C. In this embodiment, processes performed until cutting from the front side of the silicon wafer are similar to those in the above-mentioned first embodiment. Namely, as shown in FIGS. 1A to 1D, a predetermined number of unit elements 2 having plural heating elements 2*a*, 2*a*, . . . , electrodes, etc. are arranged in a silicon wafer (a silicon substrate) 1 on the basis of a desirable layout. A dicing tape 3 is mounted to a rear face of the silicon wafer 1 and is attached to a wafer ring 4. This wafer ring 4 is fixed to an unillustrated dicer. The silicon wafer 1 is cut by a cutting blade along a cutting street 10 and is divided into individual unit elements (chips) 2. In this cutting, as shown in FIG. 1D, a cutting groove 11 is formed by penetrating the cutting blade and cutting the silicon wafer 1 so as to slightly cut-in the dicing tape 3 stuck to the rear face of the silicon wafer 1 simultaneously when the silicon wafer 1 is cut. The cutting blade used here concretely has 4000 (mesh size) in surface roughness and 0.1 mm±0.002 mm in width. With respect to a penetrating amount of the blade, the silicon wafer 1 is cut at a height at which the tape (having 0.08 mm in thickness) stuck to the chips (0.625 mm in thickness) is cut-in by 0.040 mm at a cutting time. A cutting speed is set to 2.5 mm/sec.

Figure 3A:
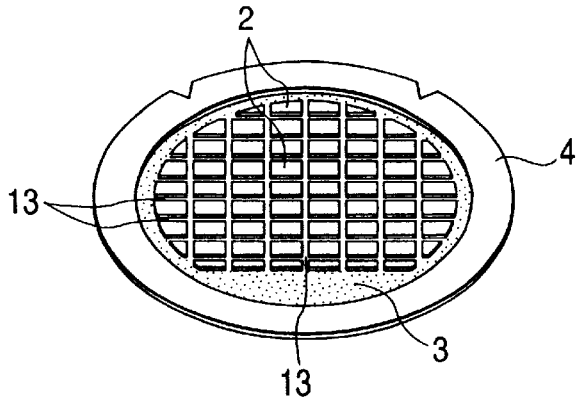
FIGS. 3A, 3B and 3C are perspective views or side views for explaining a manufacturing method of a liquid jet recording head in accordance with a second embodiment of the present invention in a process order.
Figure 3B:
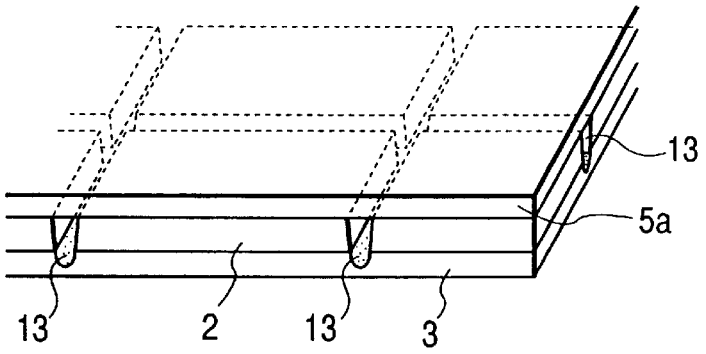
Figure 3C:
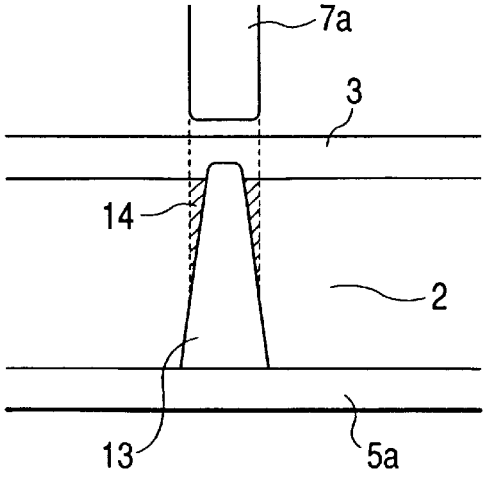

Thereafter, as shown in FIG. 3A, the dicing tape 3 mounted to the rear faces of the chips 2 is expanded (extended) and the silicon wafer 1 is extended. The cutting groove 11 is set to an expanded and extended cutting groove 13. Thereafter, a dicing tape 5*a* is mounted to surfaces of the unit elements (chips) 2 (FIG. 3B). As shown in FIG. 3C, the silicon wafer 1 is then reversely rotated and the wafer ring 4 is fixed to an unillustrated dicer. A cutting blade 7*a* having a width corresponding to that of the expanded cutting groove 13 is traveled so as to trace the cutting groove 13 from the upward directed rear face side of the silicon wafer 1. Thus, while the first mounted dicing tape 3 is cut by the cutting blade 7*a*, the cutting remaining portion near chip bottom faces in the first cutting and irregularities 14 (a hatching portion in FIG. 3C) are cut and removed. In this cutting, the cutting blade 7*a* cuts the dicing tape 3 and further cuts the wafer by penetrating the cutting blade 7*a* so as to cut-in the wafer about ⅓ to ½ times the thickness of the wafer. Concretely, the used cutting blade 7*a* has 4000 (mesh size) in surface roughness and 1 mm±0.002 mm in width. Further, it is anticipated that the penetrating amount of the blade at the cutting time from the rear face is a cutting amount of the tape +α. The silicon wafer is cut-in by 0.3 mm in height from an end face of the tape in this embodiment. A cutting speed is set to 3 mm/sec.

After the silicon wafer is cut so as to trace all the cutting grooves 13, each of the unit elements 2, 2, . . . , is separated and detached from the dicing tape 5*a* so that the unit elements 2 of preferable cutting accuracy can be obtained. Similar to the liquid jet recording head shown in FIG. 4, the unit elements (first substrate) 2 manufactured in this way are arranged on a base plate with preferable arranging accuracy and constitute an elongated substrate series. An elongated roof plate (a second substrate) having a groove shape and a concave portion constituting a discharge port, a liquid flow path, etc. is joined onto this elongated substrate series so that an elongated liquid jet recording head able to obtain a high definition image can be formed.

The cutting blade used at th e cutting time from the rear face in this embodiment has 4000 (mesh size) in surface roughness and 0.1 mm±0.002 mm in width. In this case, the dispersing range of a cutting width is about 0.004 mm and there is almost no cutting street twist since the cutting blade has a considerable thickness. In this embodiment, the surface roughness of the blade at the cutting time from the rear face of the wafer is also desirably set to be equal to the surface roughness of the blade in main cutting from a front face of the wafer. The penetrating amount of the blade at the cutting time from the rear face is desirably set to be equal to or smaller than the penetrating amount of the blade in the main cutting from the front face, and is concretely desirably set to lie within a range from 0.1 to 0.3 mm. The cutting speed of the blade at the cutting time from the rear face is desirably set to be equal to or greater than the cutting speed of the blade in the main cutting from the front face, and is concretely set to be equal to or smaller than 3 mm/sec and is particularly desirably set to lie within a range from 1.5 to 3 mm/sec.

As mentioned above, in this embodiment, after the silicon wafer mounted by the tape is cut and the tape is completely extended (expanded), the dicing tape is mounted to surfaces of the unit elements. The silicon wafer is reversely rotated and fixed to a dicer. The cutting blade corresponding to an expanded width is traveled by a certain penetrating amount roughly in accuracy so as to trace the cutting street on the front face from the rear face. It takes time to exchange cutting blades, but the chips are separated from the dicing tape after stress caused in an expanding direction on bottom faces of the unit elements (chips) at an expanding time is released by cutting using the tracing from the rear face. Accordingly, it is possible to prevent the chips from coming in contact with each other at a separating time and not a few burrs from being caused. Further, it is possible to obtain the unit elements of preferable cutting accuracy each having a cutting end face required to realize shifting of the unit elements with high accuracy (arranging accuracy) at the arranging time.

As explained above, in accordance with the present invention, damage of the chip surfaces of a cutting portion tending to be caused at the cutting time of the silicon wafer is prevented in a manufacturing process of the liquid jet recording head. Further, at least a cutting accuracy required in a lowest limit is obtained by only adding a simple rough process (a process for further mounting the dicing tape and tracing and cutting) without arranging a complicated process requiring high accuracy. Therefore, yield can be improved without increasing tact so much at a time of mass production. In particular, in a manufacturing process of the liquid jet recording head arranged in an elongated direction and requiring an arrangement of high recording density, repulsive stress is applied to the cutting blade from a cut material when a cutting blade having a certain thickness required at an obtaining time of a clear cutting face having no chipping and no cracking in a sectional cut end of a chip is used. Therefore, a wearing speed of the cutting blade is increased and generating frequency of the cutting remainder near a chip bottom face is increased. However, in the present invention, such cutting remainder near the chip bottom face can be completely cut and removed so that the arranging accuracy can be improved. Accordingly, it is very effective when the clearance between arranged chips (unit substrates) is narrowed as much as possible.

What is claimed is:

1. A manufacturing method of a liquid jet recording head having an element substrate having energy generating elements for generating energy to discharge liquid from discharge ports, and a roof plate having concave portions in communication with said discharge ports, said element substrate and said roof plate being joined to each other such that each said energy generating element corresponds to one of said concave portions to form a liquid passage, said method comprising:

cutting a substrate with a cutting blade into a plurality of said element substrates from one face side of said substrate so as to form a cutting groove in said substrate; and traveling a cutting blade so as to trace said cutting groove from the other face side of said substrate.

2. The manufacturing method of the liquid jet recording head according to claim 1, wherein said energy generating element is a heating element for generating thermal energy as said energy.

3. A liquid jet recording head manufactured by the manufacturing method of the liquid jet recording head according to claim 1, wherein a plurality of said element substrates are arranged in parallel with each other such that end faces of said element substrates formed with high accuracy are joined to each other.

4. A manufacturing method of a liquid jet recording head obtained by joining an elongated substrate series having plural first substrates each having plural heating elements arranged in parallel, and a second substrate which has plural discharge ports for discharging a liquid by utilizing heat generated by said heating elements and concave portions forming passages in communication with the plural discharge ports, said method comprising:

a first step of mounting a first dicing tape to the rear face of a silicon substrate;

a second step of cutting said silicon substrate from a front face side by a cutting blade to form said first substrates;

a third step of mounting a second dicing tape to front faces of said first substrates; and a fourth step of traveling a cutting blade so as to trace a cutting groove formed in said second step through said first dicing tape from a rear face side of said first substrates.

5. The manufacturing method of the liquid jet recording head according to claim 4, wherein the manufacturing method further includes a step of extending a distance between said first substrates after said fourth step.

6. The manufacturing method of the liquid jet recording head according to claim 4, wherein a step of extending a distance between said first substrates is further included between said second and third steps.

7. The manufacturing method of the liquid jet recording head according to claim 4, wherein a penetrating amount of said cutting blade in said fourth step is equal to or smaller than a penetrating amount of said cutting blade in said second step.

8. The manufacturing method of the liquid jet recording head according to claim 4, wherein a cutting speed of said cutting blade in said fourth step is equal to or greater than a cutting speed of said cutting blade in said second step.

9. The manufacturing method of the liquid jet recording head according to claim 4, wherein a surface roughness of said cutting blade in said fourth step is equal to a surface roughness of said cutting blade in said second step.

10. A manufacturing method of an element substrate for a liquid jet recording head having an energy generating element for generating energy utilized to discharge a liquid, said method comprising:

cutting a substrate into a plurality of said element substrates from one face side of the substrate by a cutting blade so as to form a cutting groove in said substrate; and traveling a cutting blade so as to trace said cutting groove prom the other face side of said substrate.

11. The manufacturing method of the element substrate for the liquid jet recording head according to claim 10, wherein said energy generating element is a heating element for generating thermal energy as said energy.

* * * * *

UNITED STATES PATENT AND TRADEMARK OFFICE

CERTIFICATE OF CORRECTION

PATENT NO. : 6,293,270 B1
DATED : September 25, 2001
INVENTOR(S) : Takeshi Okazaki It is certified that error appears in the above-identified patent and that said Letters Patent is hereby corrected as shown below:

Title page,
Item [57], ABSTRACT,
Line 10, "including a process for" should read -- a process including -- and "for cutting-out" should read -- into --; and
Line 11, "the element substrates" should read -- element substrates --.

Column 3,
Line 2, "publication" should read -- publications --;
Line 44, "by including the following processes" should read -- by processes including the following --;
Line 45, "for cutting-out" should read -- into --;
Line 46, "the element substrates" should read -- element substrates --;
Line 50, "Further," should read -- ¶ Further, --; and
Line 56, "A still" should read -- Still, --.

Column 4,
Line 11, "A still" should read -- Still, --; and
Line 16, "for cutting-out" should read -- into --; and
Line 17, "the element substrates" should read -- element substrates --.

Column 5,
Line 22, "cut-in" should read -- cut into --;
Line 30, "cut-in" should read -- cut into --;
Line 48, "cut-in" should read -- cut into --; and
Line 52, "cut-in" should read -- cut into --.

Column 7,
Line 7, "cut-in" should read -- cut into --;
Line 14, "cut-in" should read -- cut into --;
Line 32, "cut-in" should read -- cut into --;
Line 38, "cut-in" should read -- cut into --; and
Line 55, "th e" should read -- the --.

Column 8,
Line 20, "not a few" should read -- to prevent many --.

UNITED STATES PATENT AND TRADEMARK OFFICE

CERTIFICATE OF CORRECTION

PATENT NO. : 6,293,270 B1
DATED : September 25, 2001
INVENTOR(S) : Takeshi Okazaki It is certified that error appears in the above-identified patent and that said Letters Patent is hereby corrected as shown below:

Column 10,
Line 26, "prom" should read -- from --.

Signed and Sealed this

Sixteenth Day of July, 2002

*Attest:*

*Attesting Officer*

JAMES E. ROGAN
*Director of the United States Patent and Trademark Office*